US007036717B2

(12) United States Patent
Furini et al.

(10) Patent No.: US 7,036,717 B2
(45) Date of Patent: May 2, 2006

(54) SEALED BEVERAGE CONTAINER

(75) Inventors: Gian Luca Furini, Castelfranco Emilia (IT); Roberto Mastri, Carpi (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/332,367

(22) PCT Filed: Jul. 9, 2001

(86) PCT No.: PCT/EP01/07871

§ 371 (c)(1),
(2), (4) Date: Jan. 7, 2003

(87) PCT Pub. No.: WO02/04303

PCT Pub. Date: Jan. 17, 2002

(65) Prior Publication Data

US 2003/0146271 A1 Aug. 7, 2003

(30) Foreign Application Priority Data

Jul. 11, 2000 (EP) ..... 00830486

(51) Int. Cl.
*B65D 43/00* (2006.01)

(52) U.S. Cl. ..... 229/125.15; 229/141

(58) Field of Classification Search ..... 229/141, 229/125.15, 140, 108, 116.1
See application file for complete search history.

(56) References Cited

U.S. PATENT DOCUMENTS 3,795,359 A 3/1974 Rausing
3,961,742 A 6/1976 Stark et al.
4,054,074 A 10/1977 Maårtensson et al.
4,078,074 A 3/1978 Larsson et al.
4,078,715 A * 3/1978 Larsson et al. ..... 229/216
4,088,260 A 5/1978 Stark et al.
4,126,263 A 11/1978 Maårtensson
4,221,357 A * 9/1980 Bowden et al. ..... 229/248
4,223,789 A 9/1980 Reil
4,331,288 A 5/1982 L öthman
4,343,402 A * 8/1982 Holmstrom ..... 229/216
4,464,156 A 8/1984 Holmstr öm
4,585,498 A 4/1986 Lagerstedt et al.
4,815,655 A 3/1989 Jacobsson et al.
5,101,999 A * 4/1992 Robichaud et al. ..... 220/258.4
5,297,696 A * 3/1994 Bernstein et al. ..... 222/83
5,537,803 A 7/1996 Ols én
5,624,528 A 4/1997 Abrams et al.
5,704,541 A 1/1998 Mogard
5,938,107 A * 8/1999 Anchor et al. ..... 229/109

(Continued)

FOREIGN PATENT DOCUMENTS

JP 5-330551 * 12/1993

(Continued)

*Primary Examiner*—Tri M. Mai
(74) *Attorney, Agent, or Firm*—Buchanan Ingersoll PC

(57) ABSTRACT

A sealed package (1, 1') for pourable food products, made from sheet packaging material and having a top wall (6) crossed by a transverse sealing band (15) forming flat projecting tab (21) folded coplanar with and onto the top wall (6) along a bend line (22), and an opening device (8) fitted to a portion of the top wall (6) bounded on one side by the sealing band (15); the tab (21) has a flat striplike auxiliary portion (25) interposed between the sealing band (15) and the bend line (22), so that the area of the portion of the top wall (6) available for the opening device (8) is increased by the width of the auxiliary portion (25).

9 Claims, 4 Drawing Sheets

U.S. PATENT DOCUMENTS 6,027,016 A * 2/2000 Ljungstrom et al. ..... 229/109
6,038,838 A 3/2000 Fontanazzi
6,048,295 A 4/2000 Ols één
6,182,887 B1 2/2001 Ljunstr öm et al.
6,192,660 B1 2/2001 Moriyama et al.
6,223,924 B1 5/2001 Ek et al.
6,398,075 B1 6/2002 Laciacera et al.
6,402,019 B1 6/2002 Casale
6,443,357 B1 * 9/2002 Marbe et al. ..... 229/137

FOREIGN PATENT DOCUMENTS

WO 98/18684 5/1998

* cited by examiner

SEALED BEVERAGE CONTAINER

FIELD OF THE INVENTION

The present invention relates to a sealed package for pourable food products, and to a relative production method.

BACKGROUND OF THE INVENTION

Many pourable food products, such as fruit juice, UHT milk, wine, tomato sauce, etc., are sold in packages made of sterilized packaging material.

A typical example of such a package is the parallelepiped-shaped package for liquid or pourable food products known as Tetra Brik or Tetra Brik Aseptic (registered trademarks), which is formed by folding and sealing laminated strip packaging material. The packaging material has a multilayer structure comprising a layer of fibrous material, e.g. paper, covered on both sides with layers of heat-seal plastic material, e.g. polyethylene, and, in the case of aseptic packages for long-storage products, such as UHT milk, also comprises a layer of barrier material defined, for example, by an aluminium film, which is superimposed on a layer of heat-seal plastic material and is in turn covered with another layer of heat-seal plastic material eventually defining the inner face of the package contacting the food product.

As is known, such packages are made on fully automatic packaging units, on which a continuous tube is formed from the web-fed packaging material; the web of packaging material is sterilized on the packaging unit itself, e.g. by applying a chemical sterilizing agent, such as a hydrogen peroxide solution, which, after sterilization, is removed, e.g. vaporized by heating, from the surfaces of the packaging material; and the web of packaging material so sterilized is maintained in a closed sterile environment, and is folded and sealed longitudinally to form a vertical tube.

The tube is filled continuously from the top with the sterilized or sterile-processed food product, and is sealed and cut at equally spaced cross sections to form pillow packs, which are then folded mechanically to form the finished, e.g. substantially parallelepiped-shaped, packages.

Alternatively, the packaging material may be cut into blanks, which are formed into packages on forming spindles, and the resulting packages are filled with the food product and sealed. One example of such a package is the so-called "gable-top" package commonly known by the trade name Tetra Rex (registered trademark).

The above packages are normally provided with closable opening devices to permit consumption of, and prevent external agents from coming into contact with, the food product in the package.

The opening devices most commonly used at present comprise a frame defining an opening and fitted over a hole or a pierceable or removable portion in a top wall of the package; and a cap hinged or screwed to the frame and which is removable to open the package. Alternatively, other, e.g. slide-type, opening devices are also known to be used.

Regardless of the type of opening device used, the top wall of the package formed from the tube of packaging material has a number of sealing bands which limit the amount of space available in which to fit the opening device to the top wall. In particular, the top wall is crossed along the centerline by a flat transverse sealing band folded down onto and coplanar with the top wall; and by an end portion of a flat longitudinal sealing band extending perpendicularly from the transverse sealing band. More specifically, the longitudinal sealing band extends along a portion of the top wall of the package, and downwards from the top wall along a lateral wall and a bottom wall of the package.

Likewise, spindle-formed packages also comprise a top wall crossed along the centerline by a flat transverse sealing band folded down onto and coplanar with the top wall.

In neither case can the opening device be fitted to the sealing bands of the package, which would not only pose problems in sealing the device onto an uneven surface, but would also impair the integrity of the seals themselves.

The opening device can therefore only be fitted to the limited flat portions adjacent to the sealing bands extending across the top wall of the package, which obviously limits the maximum size of the opening device.

The above drawback is particularly felt in view of the increasing number of physically different products marketed in packages made of paperlike packaging material, some of which, particularly semiliquid products or products containing fibers or particles, require a larger opening device for the product to be poured smoothly.

To increase the space in which to fit the opening device to the package, it has been proposed to invert the direction in which the transverse sealing band is folded onto the top wall, by folding it onto the longitudinal sealing band side. The amount of extra space gained this way, however, has been relatively small.

Another proposed solution is to provide the front edge of the top wall of the package with a convex C-shaped bend line or so-called "smile crease" formed beforehand on the packaging material and projecting outwards of the package.

This solution provides for obtaining more space for the opening device than by inverting the folding direction of the transverse sealing band. Nevertheless, a demand exists in the industry for further improvement, particularly as regards research into new solutions enabling further increase in the space available on the package for even larger opening devices.

SUMMARY OF THE INVENTION

It is an object of the present invention to provide a sealed package for pourable food products, designed to provide a straightforward solution to the aforementioned drawback typically associated with known packages.

According to the present invention, there is provided a sealed package for pourable food products, made from sheet packaging material and comprising a top wall crossed by at least one transverse sealing band forming a flat projecting tab folded coplanar with and onto the top wall along a bend line, and an opening device fitted to a portion of said top wall bounded on one side by said sealing band; characterized in that said tab comprises a flat striplike auxiliary portion interposed between said sealing band and said bend line, so that the area of the portion of said top wall available for said opening device is increased by the width of the auxiliary portion.

The present invention also relates to a method of producing a sealed package of a pourable food product from sheet packaging material, said method comprising the steps of:

forming a box-shaped element open at the top and filled with said food product;

forming a top wall for closing said box-shaped element and crossed by at least one transverse sealing band forming a flat projecting tab bounding, on one side, a portion of the top wall for receiving an opening device;

folding said tab coplanar with and onto said top wall along a bend line formed beforehand on said packaging material;

characterized in that said step of forming said top wall is performed by sealing the top of said box-shaped element at a predetermined distance from said bend line on said packaging material, so that, when folded, said tab comprises, between the bend line and said sealing band, a flat striplike auxiliary portion, the width of which increases the area of the portion of said top wall available for receiving said opening device.

BRIEF DESCRIPTION OF THE DRAWINGS

Two preferred, non-limiting embodiments of the present invention will be described by way of example with reference to the accompanying drawings, in which.

DETAILED DESCRIPTION OF THE INVENTION

Figure 1:
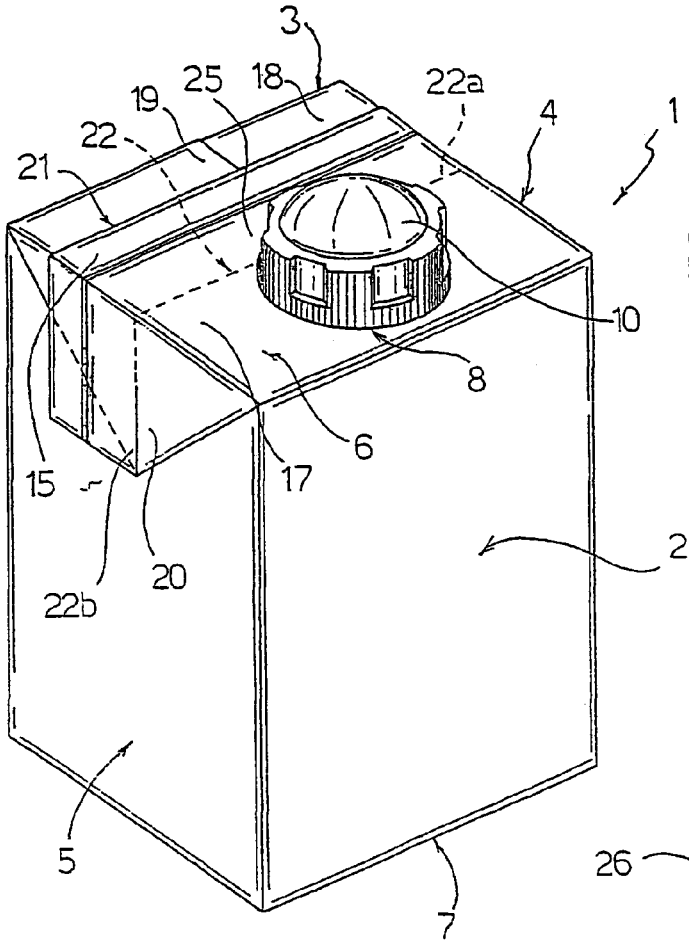
FIG. 1 shows a view in perspective of a sealed package for pourable food products, formed in accordance with the present invention.
Figure 2:
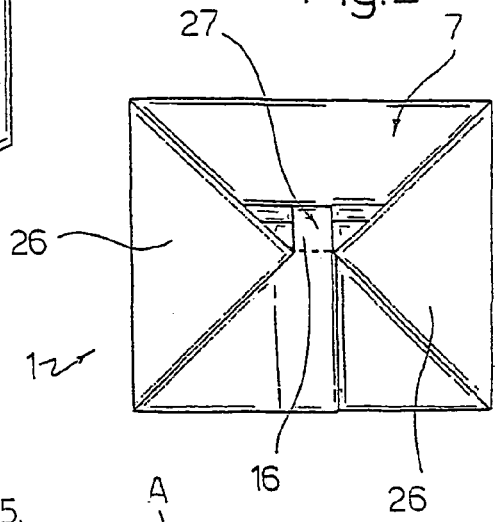
FIG. 2 shows a smaller-scale underside view of the FIG. 1 package.

Number 1 in FIGS. 1 and 2 indicates as a whole a sealed package for pourable food products, made in accordance with the present invention from sheet packaging material.

The packaging material has a multilayer structure (not shown), and comprises a layer of fibrous material, normally paper, covered on both sides with respective layers of heat-seal plastic material, e.g. polyethylene. In the case of aseptic packages for long-storage products, such as UHT milk, the side of the packaging material eventually contacting the food product in package 1 also comprises a layer of barrier material, e.g. aluminium, in turn covered with one or more layers of heat-seal plastic material.

Package 1 is parallelepiped-shaped, and is defined by two opposite, respectively front and rear, walls 2 and 3, by two opposite lateral walls 4 and 5 perpendicular to walls 2 and 3, and by two, respectively top and bottom, end walls 6 and 7 perpendicular to walls 2, 3, 4 and 5.

Package 1 also comprises a closable opening device 8 fitted to top wall 6.

Figure 5:
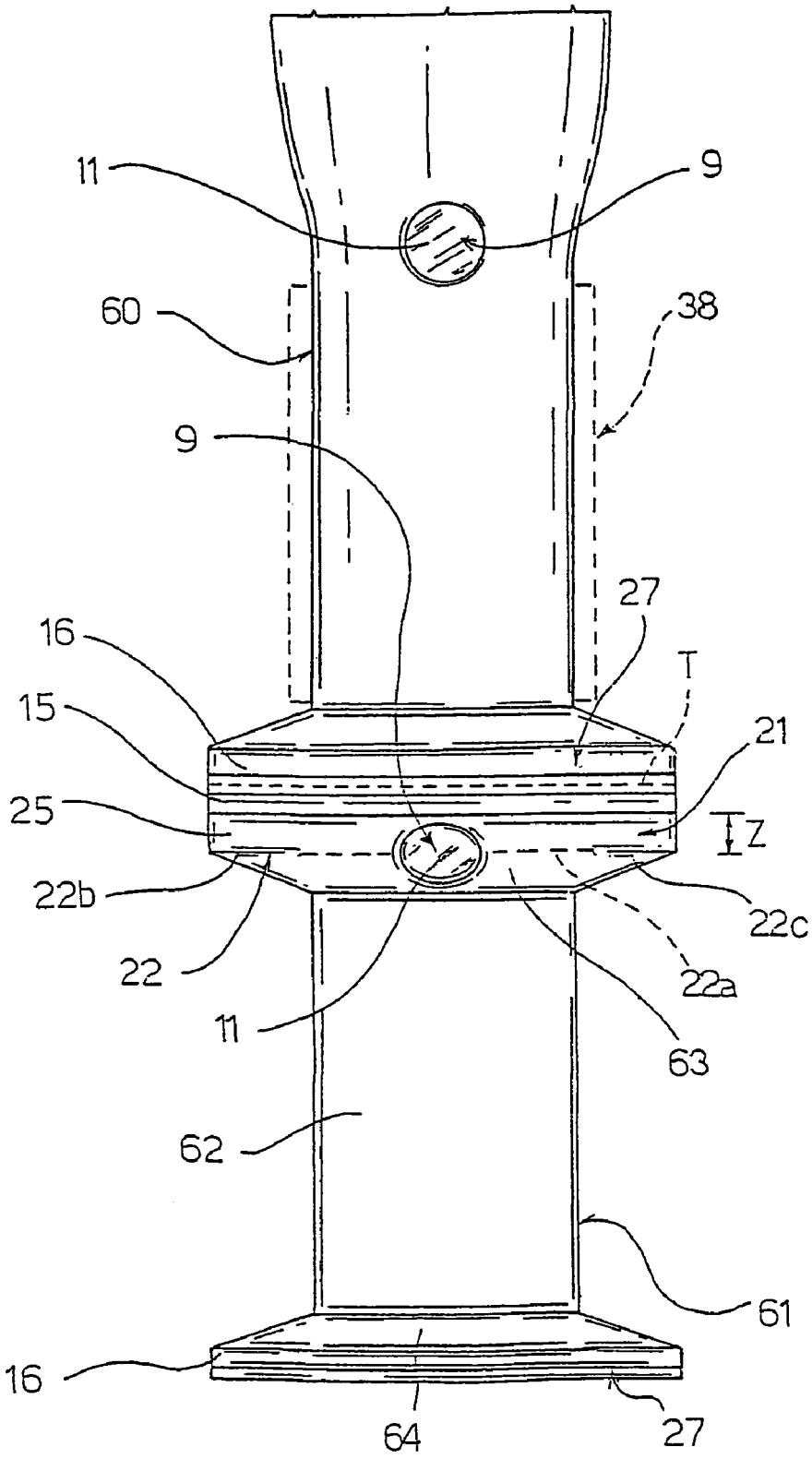
FIG. 5 shows a portion of packaging material being formed on the FIG. 3 machine.

In the example shown, opening device 8 is of the type described in Italian Patent Application n. TO99A000726 filed by the present Applicant, and substantially comprises an annular frame (not shown in the accompanying drawings) fitted about a pierceable portion 9 (FIG. 5) of wall 6; and a screw cap 10 screwed to the frame. Cap 10 is fixed or sealed directly to pierceable portion 9, according to the method described in European Patent Application n. 99830533.8 filed by the present Applicant, so that, when package 1 is unsealed, rotation of cap 10 detaches pierceable portion 9 from the rest of the packaging material.

Pierceable portion 9 may be defined by a so-called "prelaminated" hole 11 in package 1 (FIG. 5), i.e. a hole formed in the fibrous layer of the packaging material before the fibrous layer is covered with the layer of barrier material, which covers the hole hermetically and aseptically while at the same time being pierced easily.

Alternatively, package 1 may be provided with different opening devices, such as the type described in European patent Applications n. 99830621.1 and n. 99830622.9 filed by the present Applicant, and comprising an annular frame and a screw cap similar to the frame and cap 10 described above, and a cutting element housed inside the frame and activated by the cap to cut through a prelaminated hole 11 formed beforehand in the packaging material.

Package 1 may also be provided with an opening device of the type described and illustrated, for example, in International Patent Application WO98/18684, which is formed by injection molding plastic material directly over a through hole in the sheet packaging material before this is formed into package 1.

Package 1 comprises two, respectively top and bottom, flat transverse sealing bands 15, 16 extending across respective walls 6, 7 and parallel to walls 2, 3.

Sealing band 15 divides wall 6 into two portions 17, 18, one (17) of which, adjacent to wall 2, defines a portion for the application of opening device 8, while the other (18), adjacent to wall 3, comprises, substantially along the centerline, an end portion of a flat longitudinal sealing band 19 of package 1. More specifically, sealing band 19 extends perpendicularly between sealing bands 15 and 16 and along the centerline of wall 3.

Sealing band 15 extends beyond wall 6 of package 1 on both the wall 4 and 5 sides, and defines, with walls 4, 5, 6, respective flat, substantially triangular or trapezoidal lateral portions 20 of packaging material folded coplanar with and onto respective walls 4, 5 as of wall 6.

Sealing band 15 forms, lengthwise, a flat top tab 21 projecting from portions 17, 18 of wall 6 and from lateral portions 20 and folded onto portion 18 and onto portions 20 along a bend line 22 formed at the base of tab 21. More specifically, bend line 22 comprises a main portion 22*a* formed along wall 6 of package 1, exclusively on the side of portion 18 onto which tab 21 is folded; and opposite end portions 22*b*, 22*c* formed on both sides of respective lateral portions 20.

According to an important aspect of the present invention, tab 21 comprises a flat, striplike auxiliary portion 25 interposed between sealing band 15 and bend line 22- or, in other words, between sealing band 15 and the packaging material eventually forming wall 6 of package 1—so that the portion of wall 6 available for receiving opening device 8 is increased by the width of auxiliary portion 25 and may therefore accommodate larger opening devices 8 than those normally applied to known packages.

The area of portion 17 of wall 6 accommodating opening device 8 is therefore greater than that of portion 18.

With reference to FIG. 2, as on wall 6, sealing band 16 extends beyond wall 7 of package 1 on both the wall 4 and 5 sides, and defines, with walls 4, 5, 7, respective flat, substantially triangular bottom portions 26 of packaging material folded coplanar with and onto wall 7 as of respective walls 4 and 5.

Sealing band 16 forms, lengthwise, a flat bottom tab 27 projecting from wall 7 and folded coplanar with and onto wall 7 and beneath bottom portions 26 along a bend line 28 formed at the base of tab 27.

Figure 3:
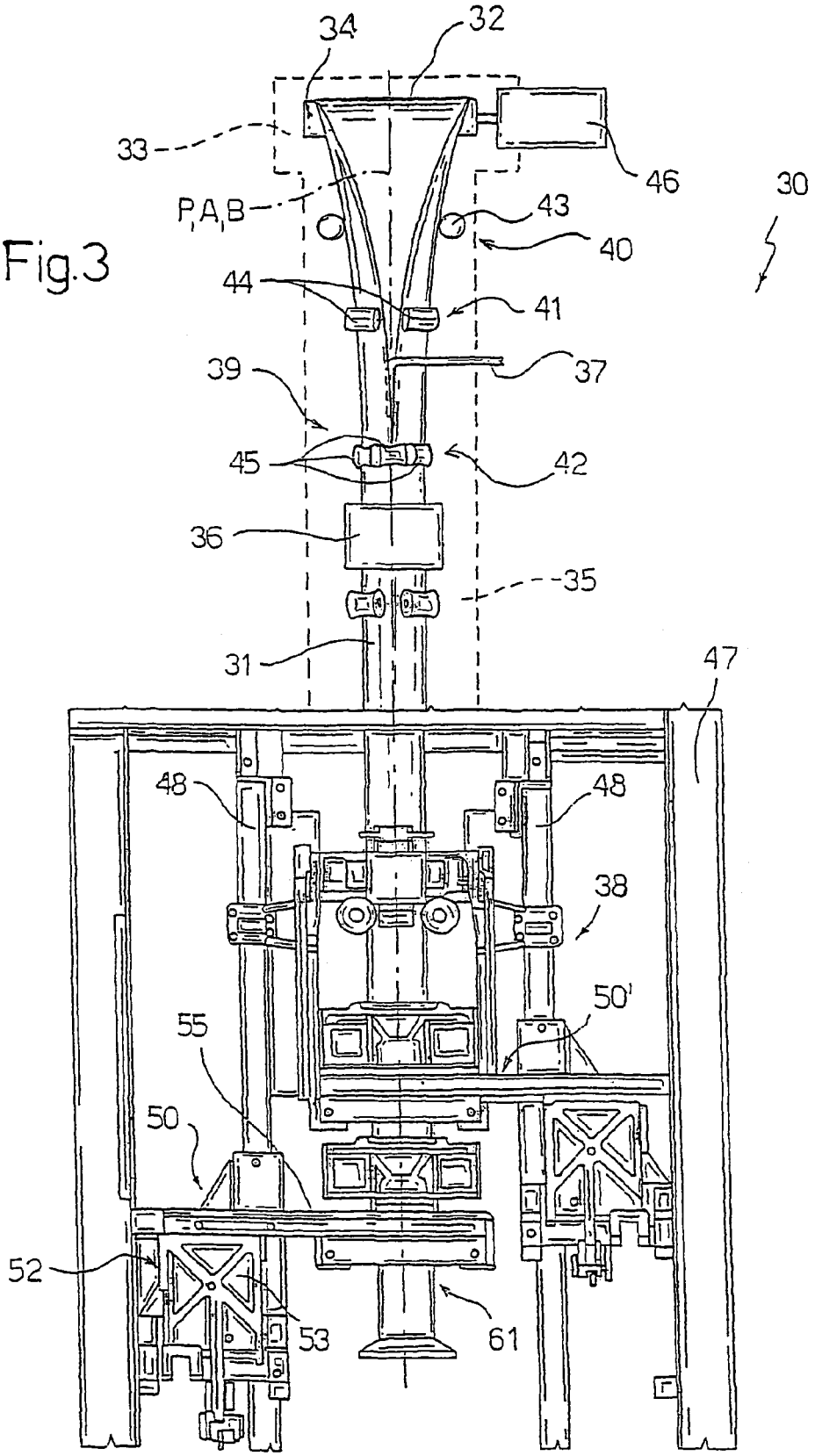
FIG. 3 shows a front view, with parts removed for clarity, of a packaging machine for producing packages of the type shown in FIGS. 1 and 2.

Number 30 in FIG. 3 indicates as a whole a packaging machine for producing a succession of packages 1 from a tube 31 of packaging material, in turn formed by longitudinally folding and sealing a web 32 of packaging material.

Web 32 comprises a succession of pierceable portions 9 (FIG. 5)—defined, in the example shown, by prelaminated holes 11—equally spaced with a spacing equal to the length of the portion of web 32 required to produce one package 1.

Along the layer of fibrous material, web 32 also comprises a series of weakening or preformed bend lines by which to bend the packaging material more easily when forming packages 1. The weakening lines are equally spaced along web 32 with the same spacing as that between pierceable portions 9, define, for example, the edges defining walls 2–7 and portions 20, 26 of the finished packages 1, and in particular include the bend lines 22, 28 of tabs 21, 27 of packages 1.

Web 32 of packaging material is unwound off a reel (not shown) and fed by known guide roller devices (not shown) through a known sterilizing unit (not shown) to a top aseptic chamber 33 of machine 30, which communicates with the sterilizing unit and through which web 32 is fed horizontally. Web 32 is then diverted downwards by a powered folding roller 34 and fed downwards along a vertical path P extending inside a vertical chamber or tower 35.

Inside tower 35, web 32 is folded into a cylinder about an axis A parallel to path P to form tube 31, which is heat sealed longitudinally by a known heat-seal device 36 (not described in detail) to form a longitudinal sealing strip from which longitudinal sealing bands 19 of the finished packages 1 originate. Tube 31 is filled continuously from the top with the food product by means of a known filling device 37 (not described in detail), and is fed to a known forming unit 38 described below only as regards the parts pertinent to the present invention.

More specifically, machine 30 comprises a folding unit 39 for longitudinally folding web 32 to form tube 31, and which is defined by a number of known folding assemblies 40, 41, 42 located along path P inside tower 35 and interacting with web 32 to fold it gradually into a cylinder and overlap the opposite lateral portions of web 32 to form tube 31 of packaging material.

Assemblies 40, 41, 42 comprise respective numbers of substantially cylindrical folding rollers 43, 44, 45 having respective axes perpendicular to axis A, and defining successive polygons surrounding axis A so that the respective lateral surfaces define successive compulsory passages for web 32 of packaging material at the forming step. As it is fed through the passages, web 32 passes from an open C shape defined by folding rollers 43 of assembly 40, to a substantially circular shape defined by folding rollers 45 of assembly 42.

The speed at which web 32 is fed through assemblies 40, 41, 42 is controlled by an electric motor 46 powering folding roller 34.

Once sealed longitudinally, tube 31 is fed to forming unit 38.

Unit 38 comprises a supporting structure 47 defining two vertical guides 48 arranged symmetrically with respect to a longitudinal vertical mid-plane B of unit 38 through axis A, and the respective axes of which lie in a transverse vertical mid-plane C of unit 38. Axis A therefore defines the intersection of planes B and C.

Unit 38 comprises, in known manner, two forming assemblies 50, 50' movable vertically along respective guides 48 and interacting alternately with tube 31 of packaging material to grip and heat seal cross sections of tube 31 to form successive transverse sealing bands 15, 16 of the finished packages 1.

Figure 4:
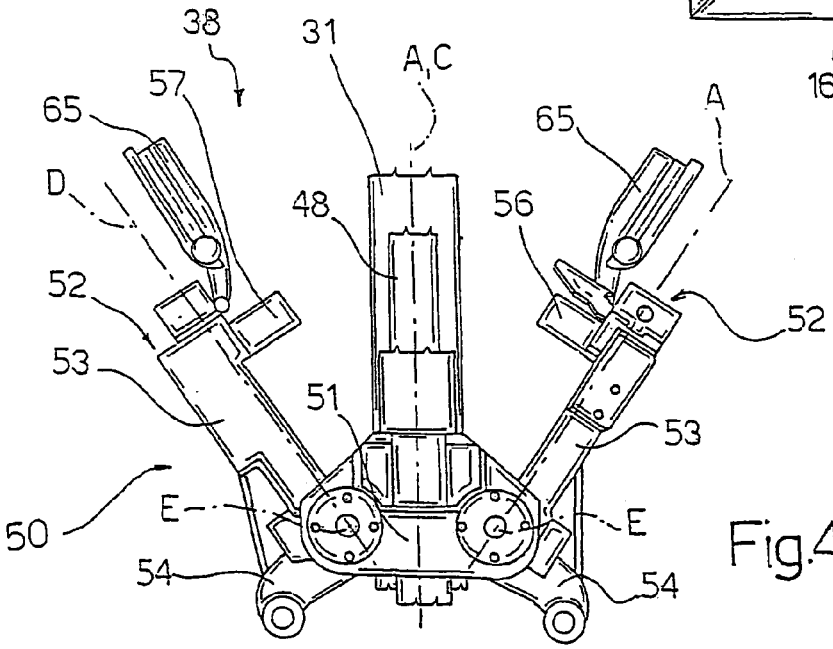
FIG. 4 shows a schematic side view of a forming unit of the FIG. 3 machine.

Since assemblies 50, 50' are symmetrical with respect to plane B, only one (assembly 50) is shown in detail in FIG. 4 and described below. In FIGS. 3 and 4, the corresponding parts of assemblies 50, 50' are indicated using the same reference numbers.

Assembly 50 substantially comprises a slide 51 movable along respective guide 48; and two jaws 52 hinged at the bottom to slide 51, about respective horizontal axes E parallel to and symmetrical with respect to plane C, so as to open and close substantially "bookfashion".

More specifically, each jaw 52 comprises a main control body 53, which is substantially in the form of a quadrangular plate, extends along a work plane D of jaw 52 containing respective axis E, is hinged close to its bottom side to slide 51, and comprises a respective control arm 54 projecting from a face of body 53 facing away from plane D.

Jaws 52 also comprise respective supporting arms 55 (FIG. 3), which are fitted to the top ends of respective bodies 53 of respective jaws 52, and project towards and beyond plane B, in a direction parallel to respective axes E and substantially along respective work planes D, so as to be located on opposite sides of tube 31.

The projecting portions of arms 55 are fitted with respective bar-shaped sealing elements 56, 57 (FIG. 4) which interact with tube 31, and which may be defined, for example, by an inductor for generating current in the aluminium layer of the packaging material and melting the layers of heat-seal plastic material as a consequence of the Joule effect, and by a mating pad against which to grip tube 31 to the required pressure.

The reciprocating movement of slides 51 and the opening/closing movement of jaws 52 are controlled in known manner (not described) by pairs of vertical rods (not shown) in turn controlled by rotary cams or servomotors.

Jaws 52 are movable between a closed position in which respective sealing elements 56, 57 grip tube 31, and a fully-open position.

At the transverse sealing step, tube 31 is heat sealed by sealing elements 56, 57 of each forming assembly 50, 50' along two parallel adjacent transverse sealing bands respectively defining the top transverse sealing band 15, and hence top tab 21, of the package 1 coming off unit 38, and the bottom transverse sealing band 16, and hence bottom tab 27, of the next package 1.

More specifically, with reference to the formation of one package 1 (FIG. 5), bottom sealing band 16 is first formed to obtain an open-topped box-shaped element 60; and top sealing band 15 is then formed to close box-shaped element 60.

Over respective sealing elements 56, 57, arms 55 of jaws 52 support respective package volume control tabs 65 having a C-shaped cross section open at the front, and which cooperate with each other, after the transverse sealing operation performed by sealing elements 56, 57, to define a cavity of predetermined shape and volume enclosing and forming tube 31 into a rectangular-section shape.

The above forming step (FIG. 5) produces "pillow" packs 61, each comprising a main portion 62 of the same shape and volume as the finished package 1 portion defined by walls 2, 3, 4 and 5; and a first and second transition portion 63, 64 connecting main portion 62 to top tab 21 and bottom tab 27 respectively, and projecting laterally with respect to main portion 62.

More specifically, top wall 6 and lateral portions 20 of a respective package 1 are obtained by folding transition portion 63 of each pillow pack 61, and bottom wall 7 and bottom portions 26 of package 1 are obtained by folding transition portion 64.

Each transverse seal of tube 31 is formed by sealing elements 56, 57 of each forming assembly 50, 50' at a predetermined distance Z from a respective underlying bend line 22 formed beforehand on web 32 of packaging material, so as to leave, between top sealing band 15 of each pillow pack 61 and the respective bend line 22 of tab 21 formed by sealing band 15, an auxiliary portion 25 of packaging material for increasing, as stated, the space available on wall 6 of each package 1 for applying respective opening device 8.

Once sealed transversely, tube 31 is fed to a known cutting unit (not shown) located downstream from forming unit 38 along path P and for separating pillow packs 61 along cutting lines T (shown schematically by the dash line in FIG. 5) interposed between adjacent transverse sealing bands 15, 16.

Figure 6:
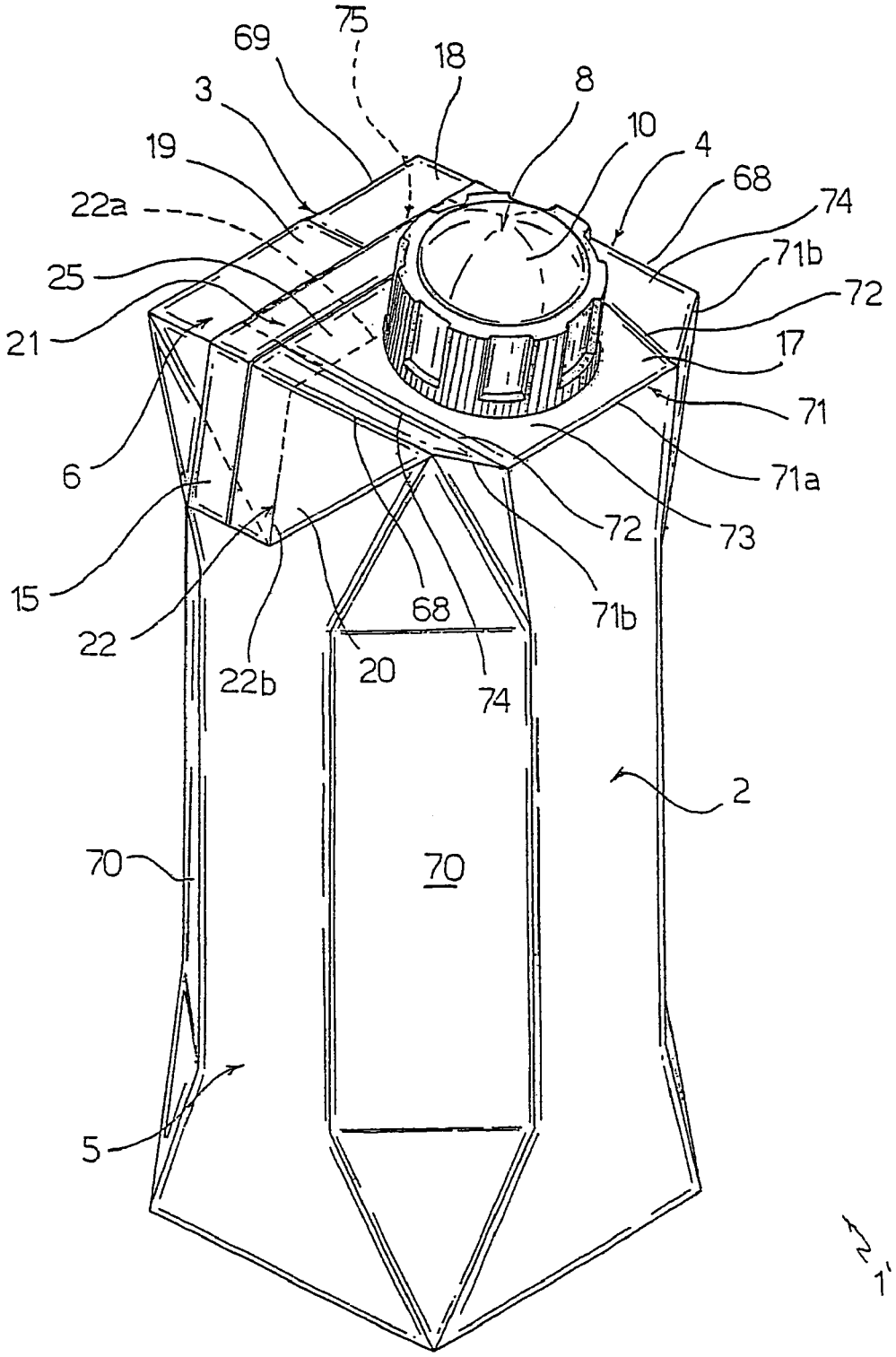
FIG. 6 shows a view in perspective of a further embodiment of a sealed package for pourable food products in accordance with the present invention.

FIG. 6 shows the basic principle of the present invention applied to a package of the type commonly known as "Tetra Prisma" and "Tetra Prisma Aseptic" (registered trademarks) and indicated as a whole by 1'. In the following description, package 1' is described only insofar as it differs from package 1, and using the same reference numbers for any parts similar or corresponding to those already described.

In particular, package 1' differs from package 1 by front, rear and lateral walls 2, 3, 4, 5 being connected to one another by beveled intermediate portions 70, and by top wall 6 being oblique and forming with wall 2 a convex C-shaped or "smile crease" front edge 71 projecting outwards.

More specifically, bottom wall 7 is flat and rectangular; while opposite wall 6 is defined towards walls 4 and 5 by respective straight lateral edges 68, towards wall 2 by front edge 71, and towards wall 3 by a straight rear edge 69 perpendicular to edges 68.

Beveled intermediate portions 70 therefore taper towards walls 6 and 7 and converge at respective vertices of walls 6, 7.

Edge 71 defines portion 17 of wall 6 on the opposite side to sealing band 15 and, by projecting outwards, combines with auxiliary portion 25 on tab 21 to considerably increase the space available on wall 6 to apply opening device 8.

More specifically, edge 71 comprises a straight intermediate portion 71*a* parallel to the portion of sealing band 15 extending across wall 6; and two oblique end portions 71*b* diverging towards sealing band 15 and connecting intermediate portion 71*a* to respective lateral edges 68 of wall 6.

Portion 17 of wall 6 comprises two additional bend lines 72 extending on opposite sides of opening device 8 and defining, with intermediate portion 71*a* of edge 71 and with sealing band 15, a flat panel 73.

Bend lines 72 are straight, extend between sealing band 15 and respective opposite ends of intermediate portion 71*a* of edge 71, extend obliquely with respect to sealing band 15, and converge towards edge 71.

Panel 73 is slightly oblique with respect to the horizontal and to wall 7, and slopes downwards towards edge 71.

Portion 17 of wall 6 also comprises two tab portions 74 which are oblique with respect to panel 73 and connect panel 73 to respective edges 68 of wall 6.

Portion 18 of wall 6 comprises a further additional bend line 75 (shown schematically by a dash line in FIG. 6) to tilt portion 18 in the same direction as panel 73 of portion 17. More specifically, bend line 75 is substantially U-shaped with the concavity facing edge 71, and is defined by two facing L-shaped portions separated by the end portion of longitudinal sealing band 19 of wall 6.

The advantages of packages 1, 1' according to the present invention will be clear from the foregoing description.

In particular, leaving a striplike auxiliary portion of packaging material (25) between sealing band 15 and bend line 22 of the tab 21 formed by sealing band 15, the space available on wall 6 of package 1, 1' to apply opening device 8 is increased by the area of the auxiliary portion. The package (1, 1') so formed may thus be fitted with a larger opening device (8), so that the content of the package is easier to pour, even in the case of semiliquid food products or food products containing fibers or particles, and the package is easier to use by the consumer, e.g. by enabling the food product to be consumed directly from the package.

Moreover, providing the same package (1') with both a C-shaped or smile crease front edge 71 and a top tab 21 containing auxiliary portion 25 of packaging material greatly increases the space available on top wall 6 of the package to apply the opening device (8).

Clearly, changes may be made to packages 1, 1' as described and illustrated herein without, however, departing from the scope of the accompanying Claims.

In particular, packages 1, 1' may be formed from blanks of packaging material formed into packages on forming spindles.

The invention claimed is:

1. A sealed package for pourable food products, made from sheet packaging material in combination with an opening device, the combination comprising a package having a top wall and a plurality of side walls and a bottom wall; the side walls and top and bottom walls being arranged to provide a sealed package; at least one transverse sealing band extending across the top wall and forming a flat projecting tab folded coplanar with and onto the top wall of the package, the top wall having a bend line in the packaging material; and an opening device mounted on a portion of said top wall bounded on one side by said sealing band and on an opposite side by an intersection of the top wall and one of the side walls; wherein said tab comprises a flat striplike auxiliary portion interposed between said sealing band and said bend line, so that the area of the portion of said top wall available for said opening device is increased by the width of the auxiliary portion; and wherein said opening device is superimposed on said top wall and on said auxiliary portion of said tab.

2. A package as claimed in claim 1, wherein said sealing band divides said top wall into a first portion and a second portion, the first portion defining the portion for receiving said opening device, and the second portion being smaller in area than the first portion.

3. A package as claimed in claim 2, wherein said tab and said sealing band extend beyond said top wall at opposite lateral walls of the package, and define, with said top wall and said lateral walls, respective flat, substantially triangular lateral portions of packaging material folded coplanar with and onto respective lateral walls as of said top wall; said bend line being formed at the base of said tab, and comprising a main portion formed along said top wall on the side of said second portion, and opposite end portions formed on both sides of respective said lateral portions.

4. A package as claimed in claim 1, being generally parallelepiped-shaped.

5. A package as claimed in claim 1, wherein said top wall comprises a convex C-shaped front edge projecting outwards and defining, on the opposite side to said sealing band, the portion of the top wall available for receiving said opening device.

6. A package as claimed in claim 5, wherein said front edge comprises a straight intermediate portion parallel to said sealing band; and two oblique end portions diverging towards the sealing band and connecting said intermediate portion to respective lateral edges of said top wall.

7. A package as claimed in claim 5, wherein said first portion of said top wall is, at least at the portion, for receiving said opening device, oblique with respect to the horizontal and slopes downwards towards said front edge; and wherein said second portion of said top wall comprises at least one additional bend line to tilt the second portion in the same direction as said first portion.

8. A package as claimed in claim 1, comprising a flat rectangular bottom wall; and a front wall, a rear wall and lateral walls connected to one another by beveled intermediate portions.

9. A package as claimed in claim 8, wherein said beveled intermediate portions taper towards said top and bottom walls and converge at respective vertices of the top and bottom walls.

* * * * *